US005678774A

United States Patent [19]

Bennett et al.

[11] Patent Number: 5,678,774

[45] Date of Patent: Oct. 21, 1997

[54] FIBERGLASS CUTTING APPARATUS AND METHOD

[75] Inventors: Bobby Ben Bennett, Reidsville; James Charles Haas, Wilmington, both of N.C.

[73] Assignee: Etc. Industries Inc., Eden, N.C.

[21] Appl. No.: 574,258

[22] Filed: Dec. 18, 1995

[51] Int. Cl.[6] ..... B02C 4/08

[52] U.S. Cl. ..... 241/27; 241/186.35; 241/236

[58] Field of Search ..... 241/236, 30, 186.35, 241/27

[56] References Cited

U.S. PATENT DOCUMENTS

| | | | |
|---|---|---|---|
| 179,100 | 6/1876 | Cormack | 241/236 X |
| 204,837 | 6/1878 | Miles | 241/236 |
| 262,051 | 8/1882 | Kelley et al. | 241/236 X |
| 3,089,409 | 5/1963 | Tretheway et al. | 241/236 X |
| 3,508,461 | 4/1970 | Stream . | |
| 3,648,554 | 3/1972 | Arnold et al. . | |
| 3,815,461 | 6/1974 | Genson . | |
| 3,873,290 | 3/1975 | Marzocchi . | |
| 4,043,779 | 8/1977 | Schaefer . | |
| 4,146,184 | 3/1979 | Whitney | 241/73 |
| 4,237,758 | 12/1980 | Lindner et al. . | |
| 4,254,536 | 3/1981 | Lehner . | |
| 4,265,151 | 5/1981 | Carruth et al. . | |
| 4,287,799 | 9/1981 | Fujita et al. . | |
| 4,373,650 | 2/1983 | Gay . | |
| 4,576,621 | 3/1986 | Chappelear et al. . | |
| 4,637,286 | 1/1987 | Boggs . | |
| 4,706,531 | 11/1987 | Blauhut et al. . | |
| 5,003,855 | 4/1991 | Ciupak . | |

*Primary Examiner*—John M. Husar
*Attorney, Agent, or Firm*—William J. Mason

[57] ABSTRACT

Fiberglass filament hulls are cut to form fiberglass staple fibers with an apparatus comprising a cutting roller with a plurality of equally spaced, circular, diamond coated cutting blades separated by circular spacers having a diameter less than the diameter of the cutting blades; a circumferentially grooved pressure roller positioned parallel to the cutting roller and forming a nip therewith, with the periphery of the blades extending in non-engaging relation into the grooves; and a conveyor for flattening and conveying the hulls into the nip of the cutting and pressure rollers with the hull filaments being oriented substantially transverse to the blades while the cutting roller is rotated at a significantly greater speed than the pressure roller, whereby the hull filaments are held against the cutting roller by the pressure roller, and cut into staple fiber lengths by the blades.

18 Claims, 2 Drawing Sheets

FIBERGLASS CUTTING APPARATUS AND METHOD

BACKGROUND OF THE INVENTION

The present invention relates to a method mid apparatus for cutting fiberglass filament into staple fiber, and in particular to the conversion of heretofore discarded continuous fiberglass filament into usable staple fibers by compressing the fiberglass band and conveying the compressed band along a pathway into engagement with a plurality of rotating cutting blades to slice the transversely positioned filaments into a plurality of staple fibers. A pressure means such as a roller is used to hold the fiberglass filaments against the cutting blades during cutting.

Continuous fiberglass filaments are manufactured by extruding molten glass through a spinnerate, followed by attenuating the extruded material. The resultant filaments, after solidifying, may then be directed to another area for conversion into desired products, or collected on a bobbin for storage prior to further processing. Formation of the filaments also normally involves the treatment of the filaments with a binder to enhance the properties of the fiberglass in subsequent operations.

As used in describing the invention, the term "continuous filament" is intended to include a single filament or a plurality of filaments in a strand. Also, a "plurality of filaments" is intended to encompass a plurality of segments of a single filament in adjacent relationships, such as occurs when a single filament is wrapped around a bobbin When fiberglass packages are formed, the continuous filament is wound onto a robe utilizing various methods and apparatus well known in the pertinent art. When the package is to be used in a subsequent process, the tube is removed from the interior of the package. The inner end of the filament is then pulled from within the interior of the package to unwind the filament.

As a result of the adhesion of adjacent filament sections in the outer part of the package by the treatment material, however, all of the filament may not be unwound from the package. Thus, the final portion of the package comprised of a continuous band of fiberglass filament adhered by the treatment material, and commonly referred to in the pertinent industry as a "hull," has heretofore been discarded, resulting in environmental concerns and economic loss.

Numerous prior art patents describe cutting of fiberglass filaments into staple fiber. Generally, the apparatus and method disclosed in these patents involves engaging a continuous strand of one or a few fiberglass filaments immediately after extrusion, with a chopping roller rotating perpendicular to the path of the strand. The chopping roller is comprised of a roller core with a plurality of spaced chopping blades projecting radially outwardly from, and parallel to, the axis of the core. Normally, filaments are engaged between the blades of the chopping roller and an adjacent surface to create a bending action, breaking the continuous filaments into staple fiber segments.

Examples of these prior art teachings include the following patents:

| U.S. Pat. No. | Inventor(s) |
|---|---|
| 5,003,855 | Ciupak |
| 4,706,531 | Blauhut et al. |
| 4,637,286 | Boggs |

-continued

| U.S. Pat. No. | Inventor(s) |
|---|---|
| 4,576,621 | Chappelear et al. |
| 4,373,650 | Gay |
| 4,287,799 | Fujita et al. |
| 4,265,151 | Carruth et al. |
| 4,254,536 | Lehner |
| 4,237,758 | Lindner et al. |
| 4,043,779 | Schaefer |
| 3,873,290 | Marzocchi |
| 3,815,461 | Genson |
| 3,648,554 | Arnold et al. |
| 3,508,461 | R. M. Stream |

While the apparatus and methodology described in the above patents is suitable for chopping continuous, extruded fiberglass filament into staple fibers, conversion of the above hulls, or other bundles of a substantial number of filaments, into useful staple fiber is not possible in the described manner, since the hulls are simply contain too many filaments to be broken into staple lengths by the action of chopper blades. Therefore, if these hulls are to be converted into useful staple fibers, a method and apparatus operating on an entirely different principal is necessary.

Accordingly, it is an aspect of the present invention to provide a method and apparatus for converting bands of continuous fiberglass filament into staple fiber. It is a particular objective of the present invention to provide a method and apparatus for cutting a compressed band of continuous fiberglass filament into staple fiber using a plurality of rotating cutting blades positioned substantially transverse to, or perpendicular to, the direction of the compressed filament.

SUMMARY OF THE INVENTION

This invention specifically relates to a method and apparatus for cutting fiberglass filament bundles into staple fiber useful for various purposes, including the reinforcement of molded plastic articles. Specifically, the present invention contemplates conveying a plurality of fiberglass filaments transversely into engagement with a plurality of spaced, rapidly rotating cutting blades, and holding the filaments against the blades during cutting to form staple fibers having a width approximately equal to the distance between the blades.

While it is possible to break a few fiberglass filaments by simply bending them sharply as is done when using a chopper roller as described in the above prior art, this procedure is not effective with fiberglass bundles containing a large number of filaments, such as are present in fiberglass hulls. Moreover, the adhesion resulting from treatment of the filaments with a lubricant increases the resistance to breaking. However, it has been discovered by the present invention that these filaments can be severed if they are held against the edge of a high speed cutting blade that has a hardness greater than the fiberglass.

The apparatus embodying this discovery desirably includes a conveyor for directing fiberglass filament hulls into the nip of a pair of oppositely rotating rollers with the hull filaments being aligned substantially parallel to the axes of the rollers. The roller pair is comprised of a cutting roller having a plurality of rapidly rotating, circular cutting blades, and a pressure means, such as a roller, to hold the filaments against the periphery of the rapidly turning blades.

Drive means is provided for rotating the pressure and cutting rollers, with the cutting roller being rotated at a substantially greater speed than the pressure roller. An adjustment means may also be provided for adjustably positioning the pressure roller relative to the cutting roller. A frame is also provided for mounting the rollers and conveyor in the desired position.

The cutting roller of the invention is comprised of a rotatable shaft, a plurality of circular cutting blades or disks supported perpendicular to the shaft at a predetermined distance from each other, and a plurality of spacers between the blades to position the blades at the desired spacing.

Each blade is in the shape of a circular disk with a central shaft receiving opening, and is constructed, at least at its periphery, of a material having a hardness greater than the fiberglass to be cut. Preferably, the blades are diamond coated blades. In most applications, the blades will have a diameter of from about 1 inch to about 16 inches, and preferably from about 6 inches to about 8 inches. The central opening in the blade will be substantially equal to the diameter of the shaft upon which the blades are mounted.

Disk-shaped spacers carried on the shaft alternate between the blades. These circular spacers also include a central opening for positioning of the spacers on the shaft. The diameter of the spacer is less than the diameter of the adjacent cutting blades, so that the blades project outwardly beyond the spacers. Desirably, the blades will project about 0.25 inch to about 2.0 inches, and preferably from about 0.50 inch to about 0.75 inch beyond the outer periphery of the spacer. The spacers may be formed of various materials but preferably are of a material that will withstand forces to which they are subjected during the high speed rotation and cutting operations. Suitable materials include steel and aluminum. The width of the spacers will be approximately equal to the length of the staple fiber to be cut, e.g., from about 0.125 inch to about 2.0 inch, and preferably from about 0.25 inch to about 1.0 inch.

The pressure roller used to hold the fiberglass filaments against the cutting blades is comprised of a central rotatable shaft with an outer coveting having a plurality of spaced, blade receiving circumferential slots or grooves. Each slot is comprised of a pair of side walls and a bottom wall, with the side walls being spaced at a distance greater than the width of a cutting blade on the cutting roller. Preferably, the groove width, i.e., the distance between the side walls, is at least 105% of the width of the cutting blade. The depth of the groove is preferably from about 0.125 inch to about 0.50 inch. The pressure roller segments between adjacent grooves will have a width less than the width of the spacers on the cutting roller.

When assembled, the blades of the cutting roller will project in a non-engaging relationship into the grooves of the pressure roller and the roller segments between grooves will project in a non-engaging relationship between adjacent blades of the cutting roller. As a result, the pressure roller will hold filaments firmly against the rotating blades during cutting. A conveyor is provided to bring bands of fiberglass filament into engagement with the cutter. The conveyor includes a loading end for introducing the fiberglass filaments and a discharge end positioned adjacent the nip of the roller pair, whereby fiberglass filaments carried by the conveyor is discharged into the roller nip and into engagement with the cutting blades. Preferably, the conveyor is comprised of a pair of opposed surfaces, with at least one surface being movable in the direction of the roller pair nip. The opposed surfaces desirably converge partially along at least a portion of the length of the conveyor in order to compress fiberglass bands introduced onto the conveyor. This conversion can be achieved by utilizing one surface having an initial segment converging towards the opposed surface and a distal segment substantially parallel to, or slightly converging towards, the opposed surface.

In the preferred embodiment, one surface of the conveyor is stationary while the other surface is movable. In this embodiment, the movable surface may be comprised of a continuous conveyor belt. The width of the conveyor surfaces should be approximately equal to each other and need be no wider than the width of the roller pair.

A drive means is provided to drive the roller pair with the speed of the cutting roller being substantially greater than the speed of the pressure roller. This drive means may be, for example, an electric motor geared to the shafts of the milers. Preferably the drive means is adapted to rotate the cutting roller at a speed of from at least about 3,000 rpm to about 10,000 rpm, and preferably from about 5,000 rpm to about 7,000 rpm. The pressure roller is geared to rotate at a speed of from about 1 rpm to up to about 25 rpm, and preferably from about 5 rpm to about 10 rpm. As a result, the edges of the blades spin against the fiberglass filaments producing a grinding action to slice through the filaments and form staple fiber lengths. This severing action is substantially different from the chopping or breaking action of prior art devices.

The roller pair is supported on an adjustable framework so that the roller shafts, while being maintained in a parallel relationship, can be moved away from or toward each other to change the depth at which the blades of the cutting roller project into the corresponding grooves of the pressure rollers. As a result of this change and the relative relationship of the two milers, the operational characteristics of the roller pair can be changed to optimize the cutting action with respect to filament bands which may vary in size, or other characteristics which effect the cutting conditions.

This adjustment may be effected by several means known in the prior art. For example, one of the rollers can be mounted in an adjustable framework positioned relative to the framework holding the other roller by a worm gear that can be mined to move the adjustable framework toward or away from the other framework. The apparatus also includes additional supports for holding the conveyor and roller pair in position relative to each other. In operation, a bundle of fiberglass filaments, such as a fiberglass hull, is positioned onto the conveyor with the filaments substantially transverse to the conveyor direction, and conveyed toward the roller pair. In the case of a fiberglass hull, the axis of the hull will be substantially parallel to the direction of the conveyor. During conveying, the opposed surfaces of the conveyor compress the filaments into a flattened state. The compressed band is released at the discharge end of the conveyor into the nip of the cutting and pressure rollers, which are rotated in opposite directions with their adjacent surfaces being rotated away from the hull, i.e., the upper surfaces of the rollers are rotated toward each other.

As the band enters the roller nip, the pressure roller holds the filaments in the band firmly against the high speed rotating blades of the cutting roller. The edges of the cutting blades then grind against the filaments, cutting them into short lengths approximately equal to the blade spacing. These staple length fibers are then discharged from the roller pair and fall, or are conveyed, to a suitable receptacle.

Other features of the invention will be apparent to one skilled in the art upon a reading of the detailed description of the invention which follows, taken together with the drawings. In the description, terms such as horizontal, upright vertical, above, beneath and the like are used solely for the purpose of clarity in illustrating the invention, and should not be taken as words of limitation.

DETAILED DESCRIPTION OF THE PREFERRED EMBODIMENT

Figure 2:
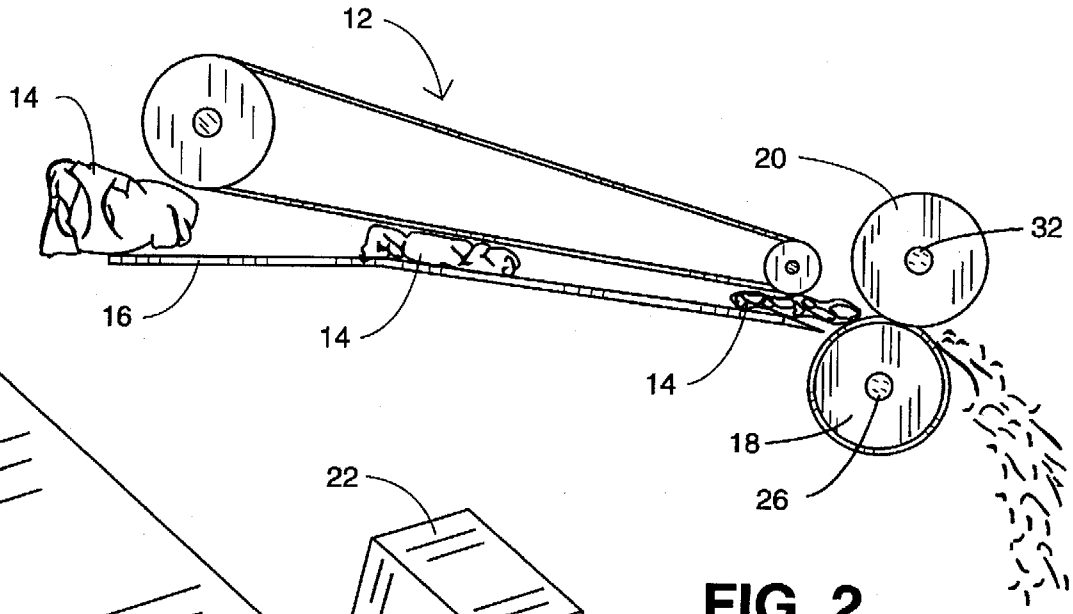
FIG. 2 is a side view of the apparatus, showing feeding of the filament hulls.
Figure 1:
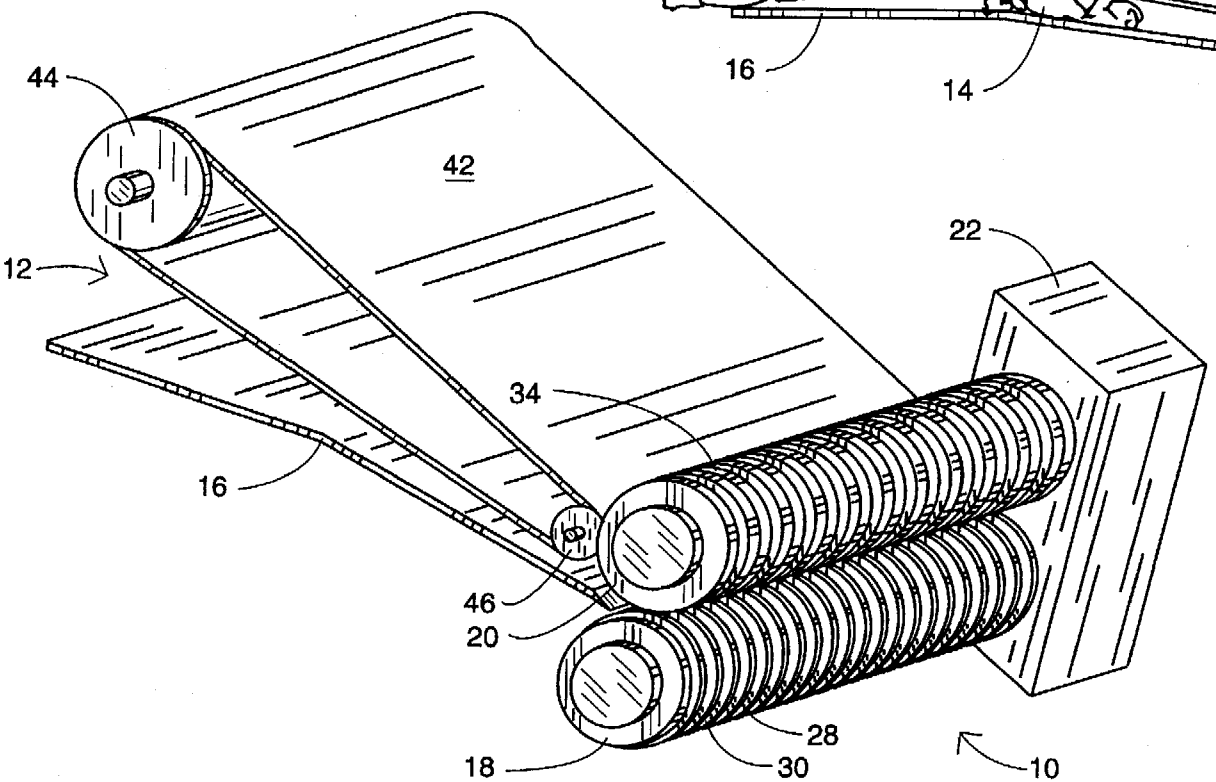
FIG. 1 is a perspective view of the apparatus of the present invention, with the supporting framework and drive means omitted for clarity.

The apparatus of the invention, as best illustrated in FIGS. 1 and 2 is comprised of processing rollers, generally 10, and a conveyor, generally 12, positioned to move filament hulls 14 along an inclined surface 16, while compressing the hulls 14 to facilitate cutting.

Figure 3:
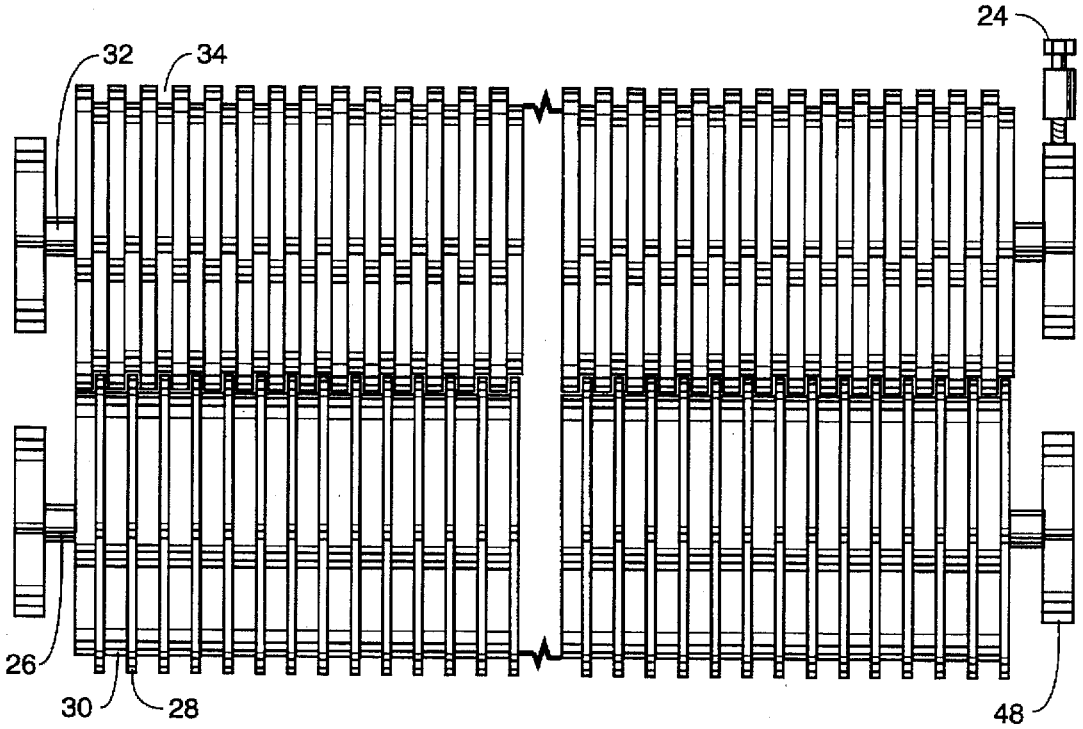
FIG. 3 is a sectional end view of the roller pair.
Figure 4:
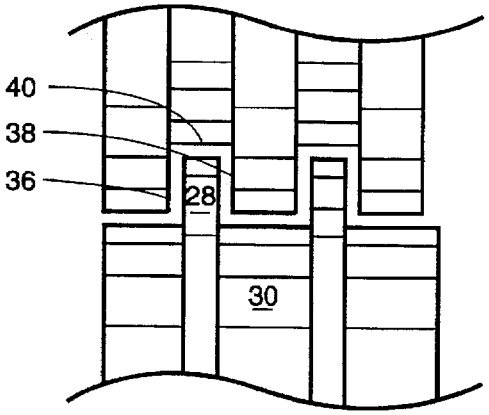
FIG. 4 is a detailed end view of roller pair showing the spacing of the cutter blades in the grooves of the pressure roller.
Figure 5:
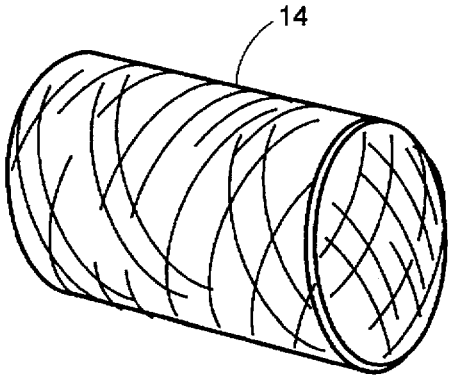
FIG. 5 is a perspective view of a filament hull of the type cut in the present invention.

Processing rollers 10 is comprised of cutting roller 18 and a pressure roller 20 aligned parallel to cutting roller 18. As illustrated in FIG. 3, a drive means 22 is provided for rotating cutting roller 18 and pressure roller 20, with cutting roller 18 being rotated at a substantially greater speed than pressure roller 20. Adjustment means 24 is provided to adjustably position pressure roller 20 in relation to cutting roller 18. An adjustable support frame, is provided to mount processing rollers 10, conveyor 12 and surface 16 in the desired position.

Cutting roller 18 is comprised of a rotatable shaft 26, supporting a plurality of equi-spaced circular cutting blades or disks 28, and a plurality of alternating, equal sized spacers 30 to space blades 28 at a predetermined, equal distance from each other. Blades 28 are of a disk or circular shape, and are diamond coated to enable the blades to cut the fiberglass filaments. In the preferred embodiment, blades 28 have a diameter of 6.0 inches, and a thickness of 0.035 inch.

Cutting roll spacers 30, as shown in the preferred embodiment, have a diameter of 5 inches. As a result, blades 28 project beyond the outer edge of spacers 30 a distance of 0.50 inch. Spacers 30 have a width of 0.375 inch.

Pressure roller 20 is supported on central rotatable shaft 32 and includes a plurality of equally spaced, blade receiving circumferential slots 34. Each slot 34 has a pair of side walls 36 and 38, and a bottom wall 40, with the distance between side walls 36 and 38 being approximately 0.375 inch, providing clearance for blade 18 to rotate in slot 34 without touching roller 20.

Rollers 18 and 20 are adjustably positioned with shafts 26 and 32 in parallel alignment, and with blades 28 projecting into slots 34 in a non-engaging relationship. The drive means is adapted to rotate cutting roller 18 as a high rate of speed relative to the speed of pressure roller 20. For example, roller 18 may be rotated at 5,000 rpm, while roller 20 is only rotated at a speed of 5 rpm. As a result, pressure roller 20 holds filaments fed into the nip of the rollers against blades 28, while blades 28 slice through the filaments.

Conveyor 12, positioned to convey hulls 14 along inclined surface 16 and into the nip of rollers 10, is comprised of continuous conveyor belt 42 around rollers 44 and 46. A drive means, not shown, rotates roller 44 to carry the lower surface of conveyor belt 42 in the direction of roller pair 10. Roller pair 10 is supported on an adjustable framework 48 so that the distance between shafts 26 and 32 can be changed to change the depth of projection of blades 28 into the corresponding grooves 34.

In operation, hulls 14 are positioned on surface 16 and are carried by conveyor 42, while being compressed, to the nip of roller pair 10. As band 14 enters the nip of the rollers 10, pressure roller 20 holds the filaments in the band tautly against the edge of blades 28 which grind against the filaments, cutting them into staple lengths. The staple length fibers are then discharged from roller pair 10 and fall, or are conveyed, to a suitable receptacle.

Certain modifications and improvements will occur to those skilled in the art upon a reading of the foregoing description. By way of example, the filament hulls can be cut into sections, with each bundle of filaments being fed transversely into contact with the cutting blades. Also, other means can be employed for conveying or feeding the filaments into contact with the cutting rollers. Additionally, other means can be employed to hold the filaments against the cutting blades. It should be understood that all such modifications and improvements have been deleted herein for the sake of conciseness and readability but are properly within the scope of the follow claims.

What is claimed is:

1. An apparatus for cutting a plurality of fiberglass filaments to form fiberglass staple fibers comprising:

a) a cutting roller having a rotatable shaft with a plurality of spaced circular cutting blades mounted thereon;

b) a pressure roller positioned parallel to said cutting roller and forming a nip therewith to hold said filaments against said blades during cutting;

c) a conveyor for conveying said filaments transversely into engagement with the periphery of said blades and into said nip; and d) a drive means for rotating said cutting and pressure rollers toward each other, said cutting roller being rotated at a greater speed than said pressure roller, whereby said filaments are held against said cutting roller by said pressure roller, and cut into staple fiber lengths by engagement with said blades.

2. The apparatus of claim 1, wherein said conveyor includes a stationary filament support surface and a moveable surface for moving filaments along said stationary surface, at least a portion of said movable surface converging toward said stationary surface.

3. The apparatus of claim 1, wherein said blades have a hardness greater than the hardness of said filaments.

4. The apparatus of claim 1, wherein said cutting roller further includes circular spacers between said blades, said spacers having a diameter less than the diameter of said cutting blades.

5. The apparatus of claim 1, further including adjustment means for moving at least one of said rollers relative to the other of said rollers.

6. The apparatus of claim 1, wherein said pressure roller includes equally spaced, circumferential grooves, and said cutting and pressure rollers are positioned in a non-engaging relationship, with the blades of said cutting roller projecting into the slots of said pressure roller.

7. An apparatus for cutting a fiberglass filament hull to form fiberglass staple fibers comprising:

a) a cutting roller having a rotatable shaft with a plurality of spaced, circular, cutting blades mounted thereon;

b) a pressure roller positioned parallel to said cutting roller and forming a nip therewith, said pressure roller including spaced circumferential blade receiving grooves, with the periphery of said blades extending in non-engaging relation into said grooves;

c) means for compressing and feeding said hull into the nip of said cutting and pressure rollers with the filaments in said hull being oriented substantially transverse to said blades; and d) drive means for rotating said cutting and pressure rollers toward each other, said cutting roller being rotated at a greater speed than said pressure roller, whereby said filaments are held against said cutting roller by said pressure roller, and cut into staple fiber lengths by engagement with said blades.

8. The apparatus of claim 7, wherein said blades are separated by circular spacers having a diameter less than the diameter of said cutting blades.

9. The apparatus of claim 7, wherein at least the periphery of said blades are diamond coated.

10. The apparatus of claim 7, wherein said drive means rotates said cutting roller at a speed of from about 3,000 to about 10,000 rpm and said pressure roller at a speed of from about 1 to about 25 rpm.

11. A method of cutting a plurality of fiberglass filaments to form fiberglass staple fibers comprising:

a) providing a cutting roller having a rotatable shaft with a plurality of parallel, spaced circular cutting blades mounted thereon;

b) providing a pressure roller positioned parallel to said cutting roller and forming a nip therewith;

c) conveying said filaments transversely into engagement with the outer periphery of said blades and into said nip while rotating said cutting and pressure rollers toward each other; and d) holding said filaments against the periphery of said blades during cutting.

12. The method of claim 11, including compressing said filaments during conveying.

13. The method of claim 11, wherein said blades have a periphery with a hardness greater than the hardness of said filaments.

14. The method of claim 11, farther including positioning spacers between said blades, said spacers having a diameter less than the diameter of said cutting blades.

15. A method for cutting a fiberglass filament hull to form fiberglass staple fibers comprising:

a) providing a cutting roller having a rotatable shaft with a plurality of equally spaced, circular, cutting blades mounted thereon;

b) providing a pressure roller positioned parallel to said cutting roller and forming a nip therewith, said pressure roller including equally spaced circumferential grooves, with the periphery of said blades extending in non-engaging relation into said grooves;

c) flattening said hull while conveying said hull into the nip of said cutting and pressure rollers; and d) rotating said cutting and pressure rollers away from said hull, said cutting roller being rotated at a greater speed than said pressure roller, whereby the filaments of said hull are held against said cutting roller by said pressure roller, and are cut into staple fiber lengths by engagement with the outer periphery of said blades.

16. The method of claim 15, wherein said blades are separated by circular spacers having a diameter less than the diameter of said cutting blades.

17. The method of claim 15, wherein the filaments in said hull are oriented substantially perpendicular to said blades during cutting.

18. The method of claim 15, wherein said cutting roller is rotated at a speed of from about 3,000 to about 10,000 rpm and said pressure roller is rotated at a speed of from about 1 to about 25 rpm.

* * * * *